US012258763B2

(12) United States Patent
Aono

(10) Patent No.: US 12,258,763 B2
(45) Date of Patent: Mar. 25, 2025

(54) STAIRCASE PART STRUCTURE EQUIPPED WITH STUDY CORNER

(71) Applicant: SEKISUI HOUSE, LTD., Osaka Osaka (JP)

(72) Inventor: Takuji Aono, Osaka Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 197 days.

(21) Appl. No.: 18/005,088

(22) PCT Filed: Aug. 6, 2021

(86) PCT No.: PCT/JP2021/029289

§ 371 (c)(1),
(2) Date: Jan. 11, 2023

(87) PCT Pub. No.: WO2022/039052

PCT Pub. Date: Feb. 24, 2022

(65) Prior Publication Data

US 2023/0257997 A1 Aug. 17, 2023

(30) Foreign Application Priority Data

Aug. 20, 2020 (JP) ..... 2020-139118

(51) Int. Cl.
*E04F 11/02* (2006.01)
*E04F 19/08* (2006.01)

(52) U.S. Cl.
CPC ..... *E04F 11/02* (2013.01); *E04F 19/08* (2013.01)

(58) Field of Classification Search
CPC ..... E04F 11/02; E04F 19/08; E04H 1/02
See application file for complete search history.

(56) References Cited

U.S. PATENT DOCUMENTS

2024/0161214 A1* 5/2024 Yonkov ..... G06Q 50/165

FOREIGN PATENT DOCUMENTS

| | | | |
|---|---|---|---|
| JP | 1991-47345 | A | 5/1991 |
| JP | 2010-7413 | A | 1/2010 |
| JP | 2017-25614 | A | 2/2017 |
| JP | 2019-148100 | A | 9/2019 |

OTHER PUBLICATIONS

International Search Report issued in application No. PCT/JP2021/029289.

* cited by examiner

*Primary Examiner* — Mark R Wendell
(74) *Attorney, Agent, or Firm* — McClure, Qualey & Rodack, LLP

(57) ABSTRACT

A first staircase part structure includes a staircase with a substantially U-shape in plan view having a first staircase part extending in a straight line in plan view from a floor of a lower floor, an intermediate part extending in a direction orthogonal to the first staircase part from an end on an upper-floor-side of the first staircase part, and a second staircase part extending from an end opposite to the first staircase part of the intermediate part substantially parallel to the first staircase part and in a direction of a foot of the first staircase part, a study corner formed by extending a stair landing formed in the first staircase part into an open ceiling space formed between the first staircase part and the second staircase part, a storage space formed below the second staircase part, and a storage rack disposed between the study corner and the storage space.

2 Claims, 7 Drawing Sheets

[Fig.1]
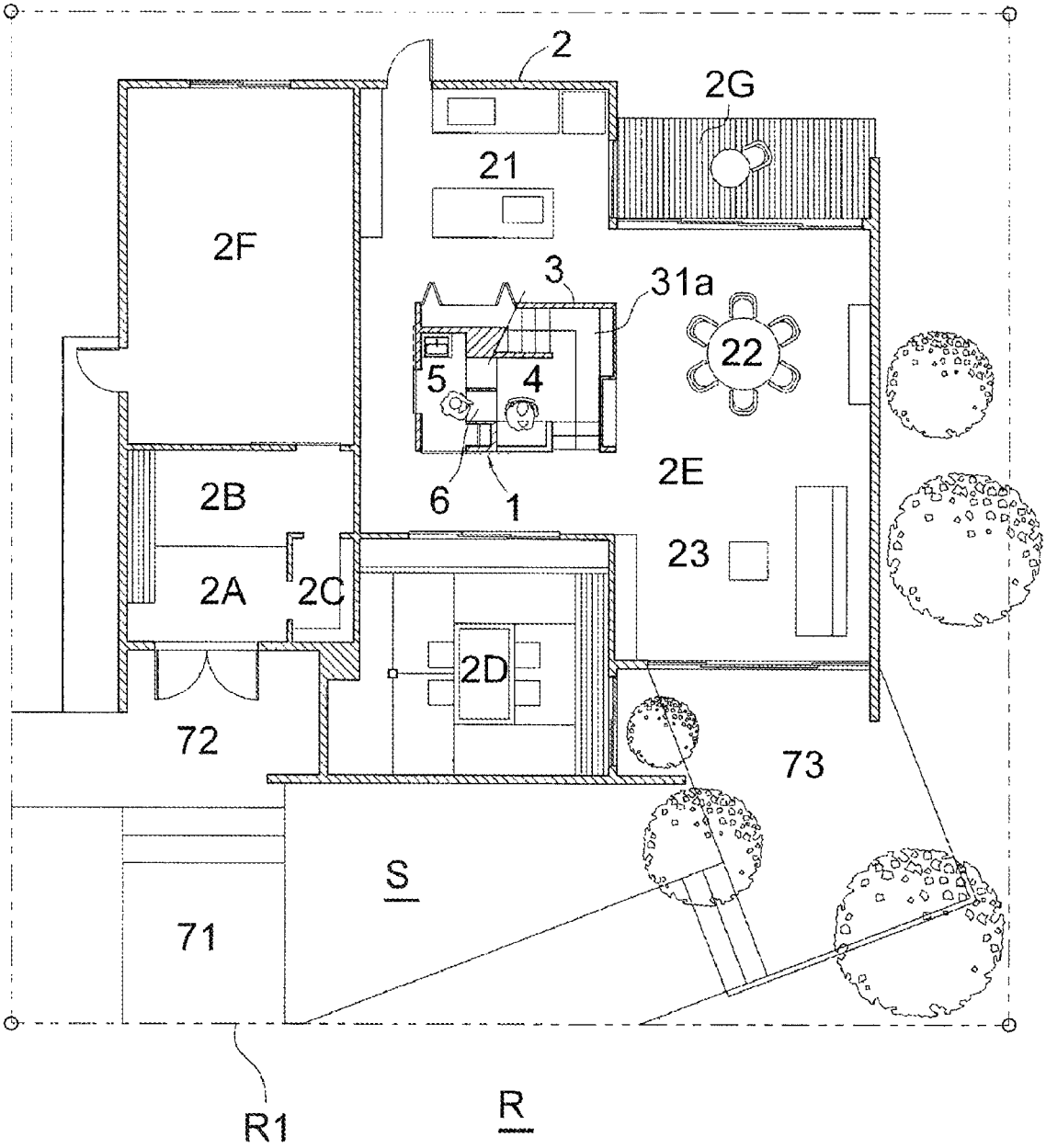

[Fig.2]
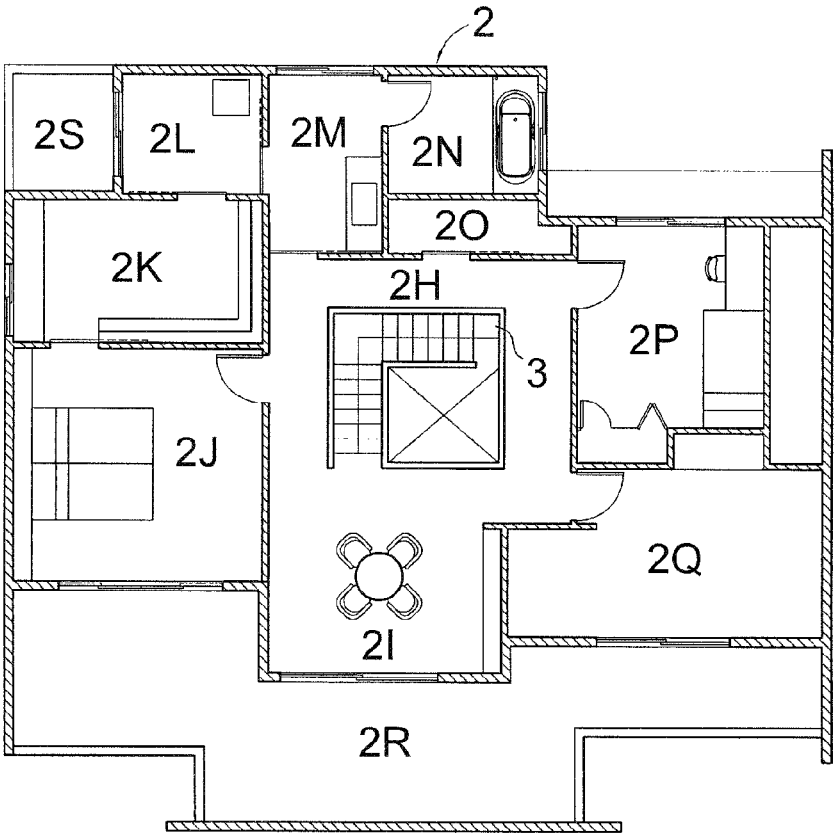

[Fig.3]
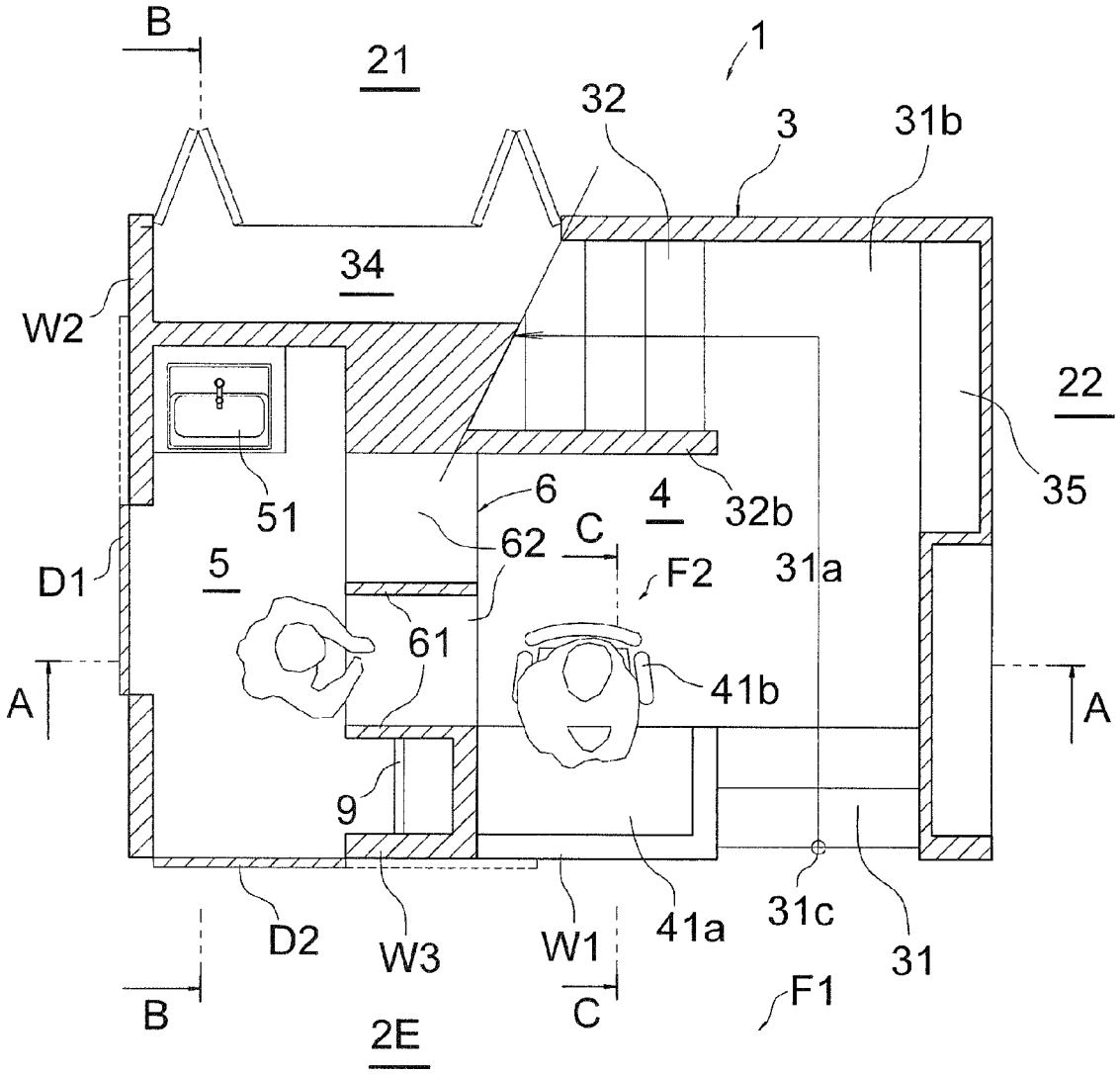

[Fig.4]
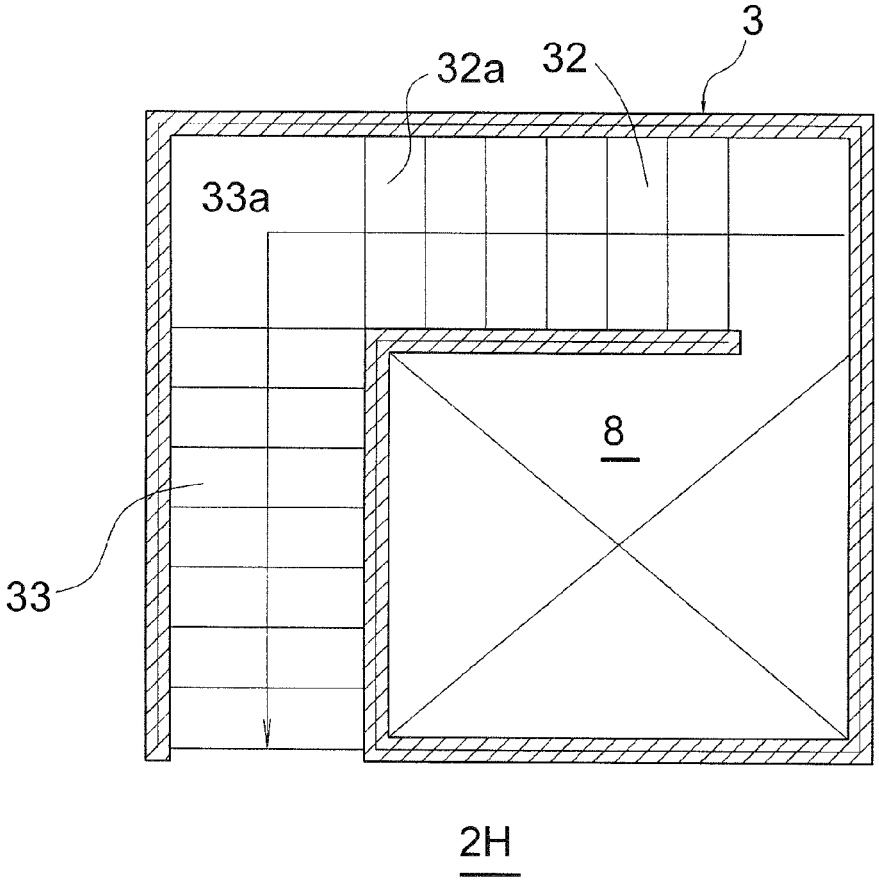

[Fig.5]
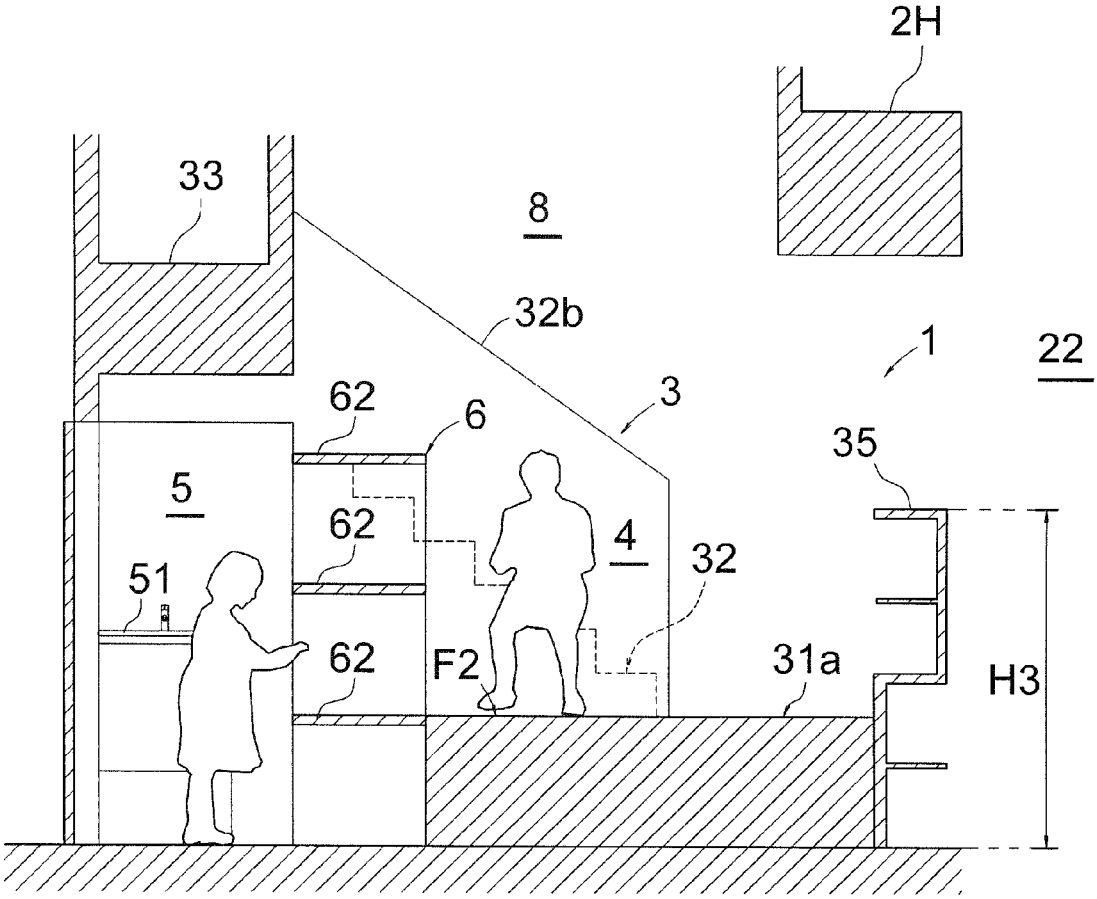

[Fig.6]
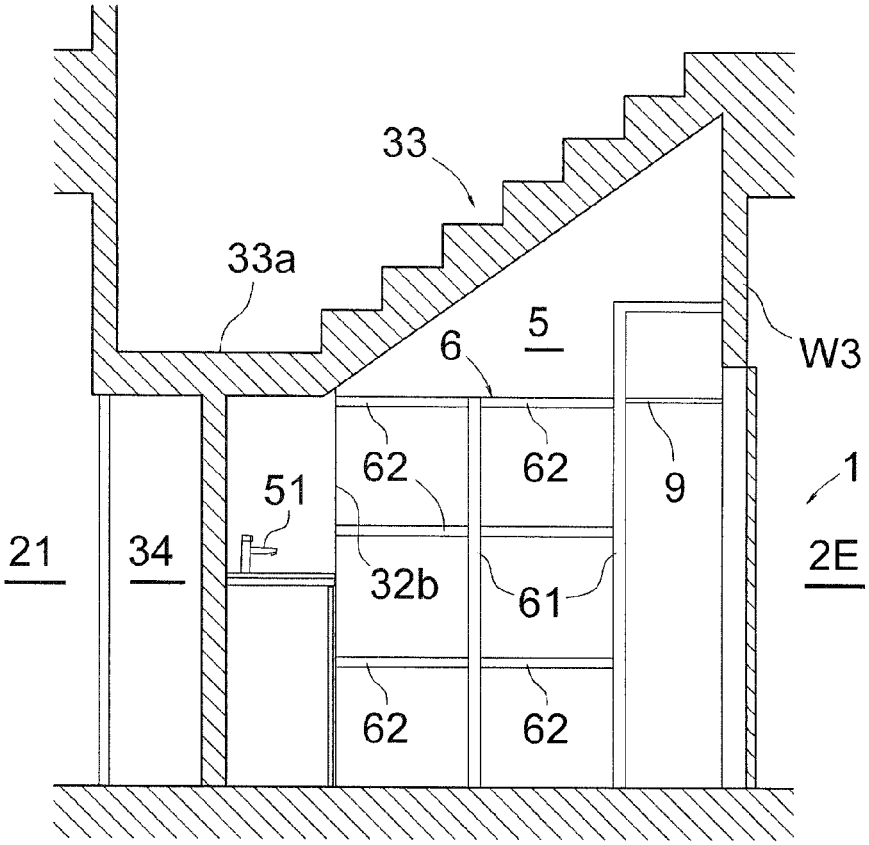

[Fig.7]
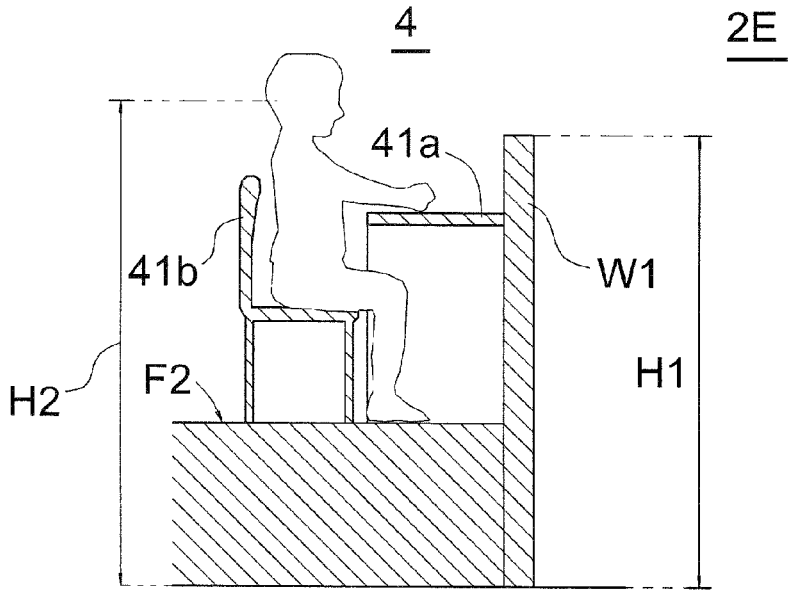

STAIRCASE PART STRUCTURE EQUIPPED WITH STUDY CORNER

TECHNICAL FIELD

The present invention relates to a staircase part structure in which a staircase connecting upper and lower floors to enable movement therebetween and a study corner for study are integrated.

BACKGROUND ART

Nowadays, there are increasing cases where, when children study at home, they study in a dining room or a living room where they can feel the presence of the family members, rather than studying in a children's room. With such a study environment, children can study in peace as the family members watch over them as compared with studying alone in their own room. However, there are also problems of distraction when studying in a living room or a dining room if the family members are too close, and children may not sufficiently concentrate on the study. Therefore, an invention has been proposed in which children can study with moderate tension while communicating with their family members (for example, Patent Literature 1).

The invention of Patent Literature 1 discloses a staircase part structure in which a stair landing of a staircase disposed in a living/dining area is expanded to make a study corner for study. In this invention, the study corner faces the living/dining area, allowing the children there to communicate with the family members in the living or dining area while allowing them to study with moderate tension.

When children study near the living or dining area, there is a problem of messiness in this area and it becomes difficult to keep the area tidy. Further, the study corner described in Patent Literature 1 has no storage space for such as children's school bags and teaching materials; therefore, these stuffs are more likely to be left in the study corner. On the other hand, the invention of Patent Literature 2 discloses providing a storage room adjacent to the study corner disposed in one corner of the living room. In this invention, teaching materials used by children and their personal belongings can be stored in the storage room, thereby effectively preventing study tools and the like from being scattered in the living room.

CITATION LIST

Patent Literatures

Patent Literature 1: JP2010-7413A
Patent Literature 2: JP2017-25614A

SUMMARY OF THE INVENTION

Technical Problems

The invention of Patent Literature 2 thus requires the installation of a storage room separately from the study corner; however, for small houses with less space, it is difficult to create a space for the storage room. Further, when children study in the study corner, there's trouble taking out teaching materials from the storage room to move them to the study corner each time.

The present invention has been made in light of the problems described above, and an object of the present invention is to provide a staircase part structure equipped with a study corner enabling children to naturally develop a habit of tidying up and to help them to efficiently study.

Solutions to Problems

A first staircase part structure equipped with a study corner according to the present invention comprises a staircase with a substantially U-shape in a plan view having a first staircase part extending in a straight line in a plan view from a floor of a lower floor, an intermediate part extending in a direction orthogonal to the first staircase part from an end on an upper-floor-side of the first staircase part, and a second staircase part extending from an end opposite to the first staircase part of the intermediate part substantially parallel to the first staircase part and in a direction of a foot of the first staircase part, a study corner formed by extending a stair landing formed in the first staircase part or the intermediate part into a space formed between the first staircase part and the second staircase part, a storage space formed below the second staircase part, and a storage rack disposed between the study corner and the storage space, wherein the study corner and the storage space communicate with each other via the storage rack.

In a second staircase part structure equipped with a study corner according to the present invention, the storage space is provided with a hand wash faucet.

In a third staircase part structure equipped with a study corner according to the present invention, the hand wash faucet is disposed at a position below an end on a lower-floor-side of the second staircase part.

In a forth staircase part structure equipped with a study corner according to the present invention, the study corner faces a living room or a dining room with a spandrel wall interposed therebetween, and a study desk is disposed to face the spandrel wall.

Advantageous Effects of the Invention

According to the first staircase part structure equipped with a study corner of the present invention, since the study corner for study and the storage space are formed integrally with the staircase, children who have returned home can store such as their bags and outerwear in the storage space and then move directly to the study corner that is adjacent to the storage space across the storage rack interposed therebetween to start studying. Therefore, children can develop the habit of voluntarily tidying up after returning home and starting studying without scattering things in other rooms such as the living room. Furthermore, since the study corner and the storage space communicate with each other via the storage rack, things can be easily transferred between the study corner and the storage space. Therefore, after returning home, the children can store their bags in the storage rack via the storage space and take out teaching materials from the bags in the study corner to start studying. Therefore, children can smoothly start studying without the trouble of carrying teaching materials. Furthermore, since the storage space is provided by utilizing the space below the staircase which is usually a dead space, and therefore the required space for the storage space is minimized, the storage space can be fairly easily provided even in a small house.

According to the second staircase part structure equipped with a study corner of the present invention, a hand wash faucet is installed in the storage space, thus allowing the children who have returned home to naturally develop a habit of washing hands, tidying up, and the like before studying.

According to the third staircase part structure equipped with a study corner of the present invention, since the hand wash faucet is installed at a position below an end on the lower-floor-side of the second staircase part, a space with a low ceiling can be effectively utilized, thereby achieving space saving.

According to the fourth staircase part structure equipped with a study corner of the present invention, the study corner faces the living room or the dining room with a spandrel wall interposed therebetween, and the study desk is installed facing the spandrel wall. This allows the children in the study corner to feel the presence of their family members in the living room or the dining room and allows them to study in peace.

BRIEF DESCRIPTION OF THE DRAWINGS

FIG. 1 is a plan view illustrating a first floor of a house.

FIG. 2 is a plan view illustrating a second floor of a house.

FIG. 3 is a plan view illustrating a staircase on the first floor.

FIG. 4 is a plan view illustrating a staircase on the second floor.

FIG. 5 is a cross-sectional view along the line A-A of FIG. 3.

FIG. 6 is a cross-sectional view along the line B-B of FIG. 3.

FIG. 7 is a cross-sectional view along the line C-C of FIG. 3.

DESCRIPTION OF EMBODIMENTS

Hereinbelow, the best embodiment of the staircase part structure equipped with a study corner according to the present invention is described with reference to the drawings. The staircase part structure equipped with a study corner according to the present invention is a structure to be used mainly for detached houses for family, but may also be used for detached houses for other households. The case for use in detached houses for families is described herein. It should be noted that "east", "west", "north", and "south" in the present invention refer to the directions to the right, to the left, upward, and downward in FIGS. 1 to 3, respectively. The "stair landing" in the present invention corresponds to the first stair landing 31*a* of the present embodiment, and the "an end on the lower-floor-side of the second staircase part" in the present invention corresponds to the second stair landing 33*a* of the present embodiment.

As shown in FIGS. 1 and 2, a staircase part structure 1 equipped with a study corner is a structure used for a detached house 2 and is provided with a staircase 3 bent in a U-shape in a plan view, a study corner 4 formed by extending a first stair landing 31*a* of the staircase 3, a storage space 5 formed in a space behind the staircase 3, and a storage rack 6 formed between the study corner 4 and the storage space 5.

As shown in FIG. 1, a site S in which the detached house 2 is installed is substantially rectangular in a plan view and people can enter into the site from the road R side located on the south. The detached house 2 is disposed close to the north of the site S, and an approach 71 disposed on the southwest, an entrance porch 72 disposed on the north of the approach 71, and a main garden 73 disposed on the southeast are provided between a road boundary line RI disposed on the south and the detached house 2.

FIGS. 1 and 2 show an example of the detached house 2 according to the present invention. In the present embodiment, the detached house 2 is a two-storied house. The first floor of the detached house 2 has an entrance earthen floor 2A adjacent to an entrance porch 72, an entrance hall 2B located on the north of the entrance earthen floor 2A, a shoe closet 2C located on the east of the entrance earthen floor 2A, a Japanese-style room 2D located on the east of the shoe closet 2C, an LDK2E located on the north of the Japanese-style room 2D occupying more than a half of the first floor, a staircase 3 disposed in the LDK2E connecting the first and second floors, a study corner 4 and a storage space 5 formed integrally with the staircase 3, a hobby room 2F located on the north of the entrance hall 2B, and a first balcony 2G disposed in an outdoor space located on the north of the LDK2E. Further, the LDK2E is adjacent to the main garden 73 located on the south, thus allowing people to move between these areas.

The second floor of the detached house 2 has the staircase 3, a hallway 2H formed to surround the staircase 3, a second living room 2I located on the south of the hallway 2H, a main bedroom 2J and a walk-in closet 2K arranged side by side in the north-south direction on the west of the hallway 2H, a laundry room 2L disposed on the north of the walk-in closet 2K, a washroom 2M and a bathroom 2N arranged side by side on the east of the laundry room 2L, a storage room 2O disposed on the south of the bathroom 2N while facing the hallway 2H, a children's room 2P disposed on the east of the hallway 2H, a guest room 2Q disposed on the south of the children's room 2P, a second balcony 2R disposed in an outdoor space on the south of the second living room 2I, and a third balcony 2S disposed on the west of the laundry room 2L.

As shown in FIG. 1, the LDK2E is a substantially inverted Z-shaped space in a plan view and comprise a kitchen 21 disposed on the west side, and a dining room 22 and a living room 23 disposed on the east side. The staircase 3 is disposed on the south of the kitchen 21 and on the west of the dining room 22 and the living room 23.

As shown in FIGS. 3 and 4, the staircase 3 has a first staircase part 31 extending in a straight line in a plan view from a floor F1 in the first floor, an intermediate part 32 extending in a direction orthogonal to the first staircase part 31 from an end 31*b* on the second-floor-side of the first staircase part 31, and a second staircase part 33 extending from an end 32*a* opposite to the first staircase part 31 of the intermediate part 32 substantially parallel to the first staircase part 31 and in a direction of a foot 31*c* of the first staircase part 31. The first staircase part 31 also has three steps from the foot 31*c*, and the third step to the end 31*b* form the first stair landing 31*a*. The second staircase part 33 also has a second stair landing 33*a* at an end on the intermediate part 32 side, and a plurality of steps are formed from the second stair landing 33*a* toward the second floor. It should be noted that the first staircase part 31 has three steps herein, although the number of steps may be less than three or may be four or more.

As shown in FIGS. 3 and 5, the study corner 4 and the storage space 5 are integrally formed with the first staircase 3. The study corner 4 is formed by extending the first stair landing 31*a* formed in the first staircase part 31 in the direction of an open ceiling space 8 formed between the first staircase part 31 and the second staircase part 33. The storage space 5 is formed below the second staircase part 33, and the storage rack 6 separating the storage space 5 from the study corner 4 is installed in the open ceiling space 8. It should be noted that as shown in FIG. 3, a portion below the second stair landing 33*a* of the staircase 3 which also faces the kitchen 21 constitute a cabinet 34. It should be noted that in the present embodiment, the entire intermediate part 32 is constituted of steps: however, the intermediate part 32 may have a stair landing extending in the direction of the open ceiling space 8 and the study corner 4 may be provided therein.

As shown in FIGS. 3 and 5, in the first staircase part 31, the side plate installed in the side surface opposite to the study corner 4 serves as a rack 35, and the staircase 3 is installed so that the rack 35 faces the dining room 22. The study corner 4 is a space for study and is formed in a range from a side wall 32*b* on the first staircase part 31 side of the intermediate part 32 to the foot 31*c* of the first staircase part 31. Further, a spandrel wall W1 having an L-shape in a plan view is formed at the boundary between the study corner 4 and the LDK2E and at the boundary between the study corner 4 and the first staircase part 31. A study desk 41*a* and a chair 41*b* for the study desk 41*a* are installed inside the spandrel wall W1. The study desk 41*a* is a general desk installed on a floor F2 of the study corner 4, and the height H1 of the spandrel wall W1 shown in FIG. 7 is higher than the upper surface of the study desk 41*a*, and is about 1400 mm to 1550 mm. On the other hand, the eye height H2 of the child sitting on the chair 41*b* is about 1590 mm to 1690 mm, and the height H1 of the spandrel wall W1 is lower than the eye height H2. By setting the spandrel wall W1 to such a height, the child can visually recognize the living room 23 while sitting on the chair 41*b*, and can study in peace while feeling the presence of the family members. On the other hand, the height H3 of the rack 35 shown in FIG. 5 is similar to the height H1 of the spandrel wall W1, and the family member(s) in the dining room 22 can visually recognize the child who is sitting in front of the study desk 41*a*. It should be noted that the study desk 41*a* does not necessarily need to be installed on the floor F2, and the level of the floor F2 may be lowered to form a sunken low table. In this case, it is preferable to lower the heights of the spandrel wall W1 and the rack 35 in accordance with the eye height of the child who will sit in front of the sunken low table.

The storage space 5 shown in FIGS. 3, 5, and 6 is a space for storing such as bags and outerwear, in which can be stored in the storage rack 6 and the clothes rack 9 facing the storage space 5. Further, the storage space 5 is disposed below the second staircase part 33 and is separated from the LDK2E by a first wall body W2 disposed on the west side and a second wall body W3 disposed on the south side while being orthogonal to the first wall body W2. A first sliding door D1 and a second sliding door D2 are provided on the first wall body W2 and the second wall body W3, respectively, thereby allowing people to move between the storage space 5 and the LDK2E. Further, as shown, the storage space 5 is provided with a hand wash faucet 51 at a position below the second stair landing 33*a*, thereby allowing children who have returned home to wash their hands before study or tidying up. Furthermore, in this way, disposing the hand wash faucet 51 in the area with a lower ceiling also allows to achieve space saving, and thus space can be effectively utilized.

The storage rack 6 shown in FIGS. 3, 5, and 6 is installed between the study corner 4 and the storage space 5 and in the open ceiling space 8. The storage rack 6 comprises a plurality of vertical plates 61 standing at intervals, and lateral plates 62 which are installed between adjacent vertical plates 61 or between the vertical plate 61 and the side wall 32*b* and on which articles are placed, wherein the storage rack 6 is installed so that the plate surface of the vertical plate 61 faces the north-south direction. The storage rack 6 opens facing the study corner 4 and the storage space 5, thereby allowing transfer of articles between adjacent spaces of the study corner 4 and the storage space 5 via the storage rack 6.

The staircase part structure 1 equipped with a study corner thus formed enables a smooth flow from when the children return home to when they start studying. That is, the child who returns home firstly passes through the entrance earthen floor 2A shown in FIG. 1 and then passes the entrance hall 2B, and enters the storage space 5 through the first sliding door D1 or the second sliding door D2 shown in FIG. 3. Then, after washing hands and gargling or the like with the hand wash faucet 51, they store bags, outerwear, and other belongings or the like in the storage rack 6 and the clothes rack 9, and move to the study corner 4. Next, after taking a break such as eating snacks at the study desk 41*a*, they take out teaching materials and other tools for study from the bag stored in the storage rack 6 to start studying. At this time, since the children do not need to carry stuffs from the storage space 5 to the study corner 4, they can smoothly start studying. Further, since the floor F2 of the study corner 4 is higher than the floor F1 of the first floor and has a good view, it is expected that the children voluntarily and enjoyably sit on the chair 41*b*. After they finish studying, the children go up the staircase 3 directly from where they are and carries the teaching materials and other tools for study to the children's room 2P, which is their own room on the second floor, and put away these stuffs.

As described above, the staircase part structure 1 equipped with a study corner according to the present application provides a flow line from the entrance earthen floor 2A to the children's room 2P including actions such as hand washing and storing outerwear after returning home, and also an action of studying. Hence this staircase part structure 1 equipped with a study corner makes it possible to allow children to voluntarily develop the habit of tidying up before start studying. Therefore, even for a child rearing family, the children can be prevented from scattering various stuffs in the living space, thereby keeping the house tidy. It should be noted that the study corner 4 is not directly facing the dining room 22 and the living room 23 in the present embodiment, although the study corner 4 may be laid out to face the dining room 22 or the living room 23 so that the children can communication with the family members more frequently.

The embodiments of the present invention are not limited to the above-described embodiments, and may be appropriately modified without departing from the scope of the present invention.

INDUSTRIAL APPLICABILITY

The staircase part structure equipped with a study corner according to the present invention can be preferably used for a detached house of a family household.

DESCRIPTION OF REFERENCE SIGNS

1 staircase part structure equipped with a study corner
22 dining room
23 living room
3 staircase
31 first staircase part
31*a* first stair landing (stair landing)

31*c* foot of a first staircase part
32 intermediate part
32*a* end opposite to a first staircase part of an intermediate part
33 second staircase part
33*a* second stair landing (end on a lower-floor-side of a second staircase part)
4 study corner
5 storage space
51 hand wash faucet
6 storage rack
W1 spandrel wall

The invention claimed is:

1. A staircase part structure equipped with a study corner, comprising:

a staircase with a substantially U-shape in a plan view having a first staircase part extending in a straight line in a plan view from a floor of a lower floor, an intermediate part extending in a direction orthogonal to the first staircase part from an end on an upper-floor-side of the first staircase part, and a second staircase part extending from an end opposite to the first staircase part of the intermediate part substantially parallel to the first staircase part and in a direction of a foot of the first staircase part;

a study corner formed by extending a stair landing formed in the first staircase part or the intermediate part into a space formed between the first staircase part and the second staircase part;

a storage space formed below the second staircase part and at a position where a slope ceiling is formed;

a storage rack disposed between the study corner and the storage space; and a second stair landing formed at an end on a lower-floor-side of the second staircase part and at an end on an opposite side to the first staircase part of the intermediate part, wherein the study corner and the storage space communicate with each other via the storage rack, and a hand wash faucet is disposed at a position where the ceiling of the storage space is the lowest and directly below the second stair landing.

2. The staircase part structure equipped with a study corner according to claim 1, wherein the study corner faces a living room or a dining room with a spandrel wall interposed therebetween, and a study desk is disposed to face the spandrel wall.

* * * * *